United States Patent [19]

Glenn

[11] 3,975,036

[45] Aug. 17, 1976

[54] SKI BOOT SCRAPER

[75] Inventor: John P. Glenn, Arvada, Colo.

[73] Assignee: The Raymond Lee Organization, Inc., a part interest

[22] Filed: Nov. 25, 1975

[21] Appl. No.: 635,118

[52] U.S. Cl. ..... 280/11.37 E

[51] Int. Cl.[2] ..... A63C 11/00

[58] Field of Search ..... 280/11.37 E, 11.37 R, 280/605, 601

[56] References Cited

UNITED STATES PATENTS

| | | | |
|---|---|---|---|
| 3,284,091 | 11/1966 | Spier | 280/11.37 E |
| 3,350,111 | 10/1967 | Sahlein et al. | 280/11.37 E |

*Primary Examiner*—M. H. Wood, Jr.
*Assistant Examiner*—David M. Mitchell

[57] ABSTRACT

A flat base plate is attached to a ski, and supports a transversely extending hinge that is attached to the bottom edge of a flat rectangular metal piece. A spring biases the piece to pivot about its bottom edge to a generally vertical position, where it presses against two inclined braces that extend upwardly from the base plate to support the piece and preventing it from rotating past its desired position. A catch means is attached to the ski and cooperates with the piece to hold the piece in a generally horizontal position when locked and allowing the piece to abut the braces when the catch means is unlocked.

2 Claims, 3 Drawing Figures

FIG. 1
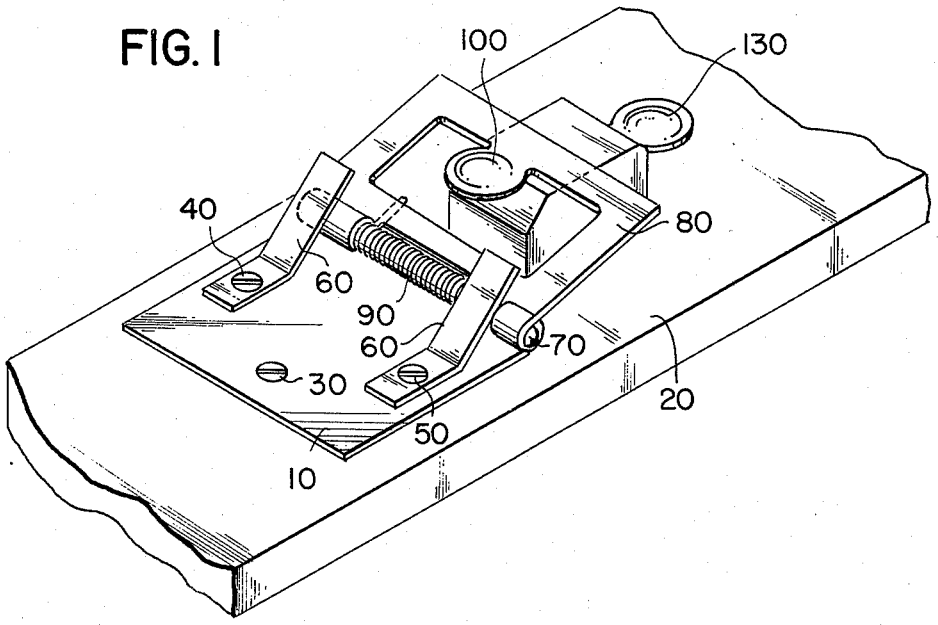
FIG. 2
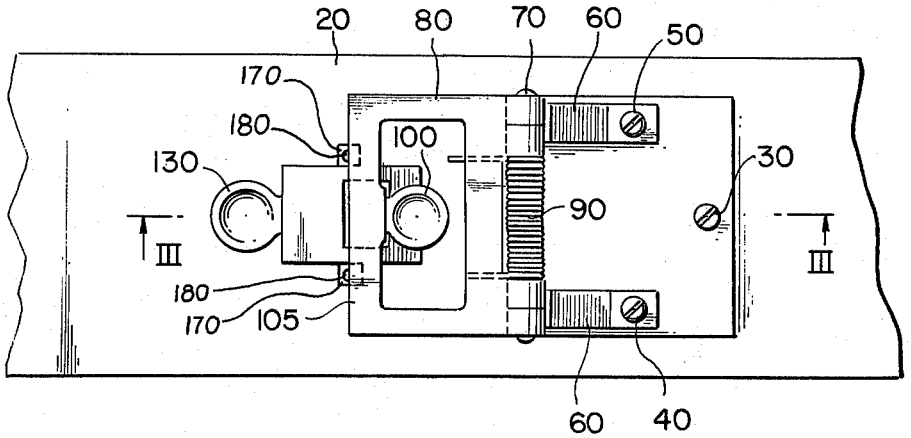
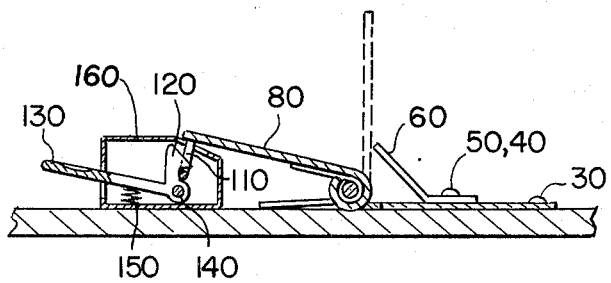
FIG. 3

SKI BOOT SCRAPER

SUMMARY OF THE INVENTION

The object of the invention is to provide a device that can be attached to a ski for scraping snow and ice off the bottom of the user's ski boots prior to locking the boots into their bindings.

Thus, the bottom edge of a rectangular piece is attached to a transversely extending hinge that is attached to each ski. A spring urges the piece to rotate about its bottom edge, to press against braces that support the piece in a generally vertical position. When in this generally vertical position, the user may scrape ice and snow off the bottom of his boots by scraping them on the top edges of the pieces.

A catch means mounted on the ski holds the piece in a generally horizontal position when locked. When unlocked, the piece is freed to rotate up to abut the braces. The piece can then be pushed down again and the catch means relocked.

It is to be noted that although the invention has been described as a single unit, it is contemplated that the invention will be used in pairs, with one unit on each of the user's skis.

BRIEF DESCRIPTION OF THE DRAWINGS

FIG. 1 is a drawing of the invention.

FIG. 2 is a top view of the invention.

FIG. 3 is a view along line III—III of FIG. 2.

DETAILED DESCRIPTION OF PREFERRED EMBODIMENTS

A flat metal base plate 10 is attached to the top surface 20 of a ski by screws 30, 40 and 50. Screws 40 and 50 each also extend through a corresponding brace 60. The braces being bent, elongated rectangular metal strips with inclined flanges extending upwardly from the ski.

One side of the base plate is formed into a conventional hinge structure that supports an elongated, transversely extending hinge pin 70. A similarly conventional hinge structure attaches the bottom edge of a rectangular metal piece 80 to the pin. A wire torsion spring 90 that is wound around the pin urges the piece forward to press against the braces and thus be propped up to a generally vertical position.

The piece has an open rectangular center, and a round tab 100 extends into it from the top edge 105 to this tab is connected a slotted member 110 that extends downwardly from the piece when the piece is held in a generally horizontal position.

To hold the piece in such a position when not needed, a catch with a hook 120 and a lever 130 extending at right angles to the hook is pivoted at the intersection of hook and lever on transverse axle 140. Compression spring 150 is placed between the ski and the lever, and urges the hook into the alotted member, to keep the piece horizontal until the lever is depressed, disengaging the hook from the slotted member and releasing the piece to rotate up against the braces. The catch, and spring 150 mechanism are enclosed in housing 160, to prevent damage.

The housing has two opposed flanges 170 extending outwardly from its sides. Screws 180 extend through the flanges to attach the housing to the ski.

After the user has scraped his foot over the top edge and removed ice and snow from the bottom of the boot, the piece can be depressed and the catch re-engaged with the slotted member.

It is to be noted that only one unit has so far been described. However, it is contemplated that the invention will be manufactured in pairs, with each unit in the pair being installed upon a corresponding one of the user's skis.

What is claimed is:

1. A ski boot scraper for use on skis, comprising:

a flat, rectangular piece;

a hinge extending transversely across the ski attached to the bottom edge of the piece to allow it to pivot about its bottom edge;

a spring biasing the piece towards a generally vertical position;

braces attached to the ski for abutting and thereby supporting the piece in a generally vertical position against the pressure of the spring; and a catch means attached to the ski and cooperating with the piece to hold the piece in a generally horizontal position when the catch means is locked and allowing the piece to abut the braces when the catch means is unlocked.

2. The device of claim 1 wherein the braces are two like opposed inclined flanges extending upwardly from a flat base plate to which the hinge is attached and which is attached to the ski.

* * * * *